US005390496A

United States Patent [19]

El Affaqui

[11] Patent Number: 5,390,496

[45] Date of Patent: Feb. 21, 1995

[54] STIRLING ENGINE WITH ANNULAR CAM

[76] Inventor: Thami El Affaqui, 108 Glenbrooke Crescent, Pointe-Claire, Québec, Canada, H9R 3X8

[21] Appl. No.: 206,086

[22] Filed: Mar. 4, 1994

[51] Int. Cl.[6] ..... F02G 1/044

[52] U.S. Cl. ..... 60/525; 60/517

[58] Field of Search ..... 60/516, 517, 518, 519, 60/525, 526

[56] References Cited

U.S. PATENT DOCUMENTS

| | | | |
|---|---|---|---|
| 2,475,770 | 7/1949 | Wijsman | 60/525 |
| 4,179,890 | 12/1979 | Hanson | 60/519 |
| 4,392,350 | 7/1983 | Marks | 60/518 |
| 4,413,474 | 11/1983 | Moscrip | 60/517 |
| 4,428,197 | 1/1984 | Liljequist | 60/525 |
| 4,677,825 | 7/1987 | Fellows | 60/525 |
| 4,779,421 | 10/1988 | Fellows | 60/525 |
| 5,095,700 | 3/1992 | Bolger | 60/517 |
| 5,177,968 | 1/1993 | Fellows | 60/525 |

*Primary Examiner*—Ira S. Lazarus
*Assistant Examiner*—L. Heyman
*Attorney, Agent, or Firm*—Galgano & Burke

[57] ABSTRACT

The Stirling engine uses an annular cam for converting the reciprocating movements of the pistons of the engine in a rotating movement. The annular cam is concentric with the engine block and provides movement to a first piston located in a first radial cylinder. A second piston located in a second radial cylinder provides work to the annular cam. A working gas circuit located between the first and the second cylinders is provided for powering the engine. The circuit comprises a cooling assembly, a regenerator and a heating assembly. The pistons are operatively connected to the annular cam by means of a radial rod at the end of which are located rollers engaged with the inner cam path and maintained by an inner guide parallel to the cam path. The engine provides a very simple and economical construction of the Stirling engine.

9 Claims, 13 Drawing Sheets

STIRLING ENGINE WITH ANNULAR CAM

FIELD OF THE INVENTION

The present invention relates to a Stirling engine using an annular cam for converting the reciprocating movements of the pistons in a rotating movement.

BACKGROUND OF THE INVENTION

The Stirling engine was invented by the Reverend and engineer Robert Stirling in the early 19th century as an alternative to steam engines which were very dangerous because of the numerous explosions thereof.

A Stirling engine is a machine which operates on a closed regenerative thermodynamic cycle with periodic compression and expansion of a working gas at different temperature levels. It has pistons moving in cylinders but the movement of the pistons is not caused by a pressure variation due to the combustion of a gas as in the internal combustion engine. Instead, the Stirling engine uses a working gas circulating in closed circuit between one or more pairs of pistons. The flow of the working gas is controlled by volume changes in such a way as to produce a net conversion of heat to work. The heat is provided by an external heat source allowing either continuous combustion of various liquid, gaseous or even solid fuels, or either the use of solar, geothermal or waste energy from another process or engine.

Nowadays, there are two main embodiments to the Stirling engine. The first one comprises free pistons generating a linear movement. The second one comprises a crankshaft operatively attached to a piston by a connecting rod. The movement of pistons may be directly transmitted to the crankshaft or be transmitted to a diamond-shaped driving mechanism mechanically connected to two counted-rotating crankshafts. None of these Stirling engines is mass produced mainly because they are complex and because of their uneconomical cost. Additionally, the movement of the pistons in these engines is also continuous.

Although the Stirling engines are not very common on the market, they have many advantages. They allow very low concentrations of pollutants, a quiet running without combustion noise and a fuel consumption which roughly corresponds to diesel engines at equivalent speeds.

SUMMARY OF THE INVENTION

An object of the present invention is to provide a Stirling engine having a very simple design eliminating the use of a crankshaft, for converting the reciprocal movements of the pistons in a rotating movement. Additionally, the present invention allows to have discontinuous movements of the pistons for getting closer to the ideal Stirling cycle.

More particularly, the object of the present invention is to provide a Stirling engine having an engine block defining a main axis, the engine comprising:

a first and a second radial cylinder symmetrically disposed in the engine block around the main axis, each of the cylinders having a gas opening adjacent the main axis;

a circuit connected between the openings of the cylinders and containing a working gas, the circuit being provided with:

cooling means, connected to the opening of the first cylinder, for cooling the working gas;

regenerator means, connected to the cooling means opposite the first cylinder, for storing heat from the working gas when flowing towards the cooling means and restoring stored heat to the working gas when flowing away from the cooling means; and heating means for heating the working gas, the heating means having a first end connected to the regenerator means opposite the cooling means and a second end connected to the opening of the second cylinder;

an annular cam substantially concentric with the main axis and rotatable around the main axis, the annular cam having an inner cam path corresponding to at least one engine cycle including a power phase and a return phase separated by dead centers;

means for guiding the annular cam around the engine block;

a first piston located in the first cylinder for compressing and transferring the working gas to the second cylinder during the power phase;

a second piston located in the second cylinder for transmitting power to the annular cam during the power phase; and means for operatively connecting the pistons to the annular cam so that the pistons are at radial positions which are a function of an angular position of the annular cam, whereby, in use, the annular cam is rotated with respect to the engine block and receives power from the second piston.

According to a preferred embodiment, the annular cam comprises a first and a second annular part adjacent to each other, the means for operatively connecting the pistons to the annular cam connecting the first piston to the first part and the second piston to the second part.

According to another preferred embodiment, the means for operatively connecting the pistons to the annular cam comprise:

a plurality of radial rods attached respectively to the first and second pistons and outwardly projecting therefrom; and means connected at a free end of each rod for following the cam path, whereby the rod is moved into reciprocal radial movements upon rotation of the annular cam.

According to a still preferred embodiment, the means for following the cam path comprise a roller operatively connected to the annular cam between the cam path and an inner guide substantially parallel to the cam path.

According to a still preferred embodiment, the Stirling engine further comprises means for cooling the first cylinder.

According to a still preferred embodiment, the heating means comprise a fuel burner. Preferably, the heating means comprise a fan driven by the engine and providing air to the heating means for allowing fuel to burn.

It is also an object of the present invention to provide a Stirling engine having an engine block defining a main axis, the engine comprising:

three first radial cylinders symmetrically disposed in the engine block around the main axis, each of the first cylinders having a gas opening adjacent the main axis;

three second radial cylinders symmetrically disposed in the engine block around the main axis, each of the second cylinders having a gas opening adjacent the main axis;

three circuits containing a working gas, each connected between openings of a corresponding pair of the first and second cylinders, each circuit being provided with:

cooling means, connected to the opening of the corresponding first cylinder, for cooling the working gas;

regenerator means, connected to the cooling means opposite the corresponding first cylinder, for storing heat from the working gas when flowing towards the cooling means and restoring stored heat to the working gas when flowing away from the cooling means; and heating means for heating the working gas, the heating means having a first end connected to the regenerator means opposite the cooling means and a second end connected to the opening of the corresponding second cylinder;

an annular cam substantially concentric with the main axis and rotatable around the main axis, the annular cam having a smooth inner cam path corresponding to three engine cycles, each including a power phase and a return phase separated by dead centers;

means for guiding the annular cam around the engine block;

first pistons located respectively in the first cylinders for compressing and transferring the working gas from the first cylinders to the second cylinders during the power phase;

second pistons located respectively in the second cylinders for transmitting power to the annular cam during the power phase and for transferring the working gas from the second cylinders to the first cylinders during the return phase; and means for operatively connecting the pistons to the annular cam, whereby, in use, the annular cam is rotated with respect to the engine block and receives power from the second piston.

It is also an object of the present invention to provide a Stirling engine having an engine block defining a main axis, the engine comprising:

at least two radial cylinders symmetrically disposed in the engine block around the main axis, each of the cylinders having a first gas opening opposite the main axis and a second gas opening adjacent the main axis;

at least two circuits for connecting respectively the at least two cylinders, each of the circuits being connected respectively between the first opening of one cylinder and the second opening of an adjacent cylinder, each of the circuits containing a working gas and being provided with:

cooling means, connected to the first opening of a corresponding cylinder, for cooling the working gas;

regenerator means, connected to the cooling means opposite the first opening of the corresponding cylinder, for storing heat from the working gas when flowing towards the cooling means and restoring stored heat to the working gas when flowing away from the cooling means; and heating means for heating the working gas, the heating means having a first end connected to the regenerator means opposite the cooling means and a second end connected to the second opening of another corresponding cylinder;

an annular cam substantially concentric with the main axis and rotatable around the main axis, the annular cam having an inner cam path corresponding to at least one engine cycle including a power phase and a return phase separated by dead centers;

means for guiding the annular cam around the engine block;

one piston located in each cylinder for simultaneously transferring the working gas to an adjacent cylinder and transmitting power to the annular cam; and means for operatively connecting the pistons to the annular cam, whereby, in use, the annular cam is rotated with respect to the engine block and receives power from the pistons.

A non restrictive description of a preferred embodiment will now be given with reference to the appended drawings.

IDENTIFICATION OF THE ELEMENTS

Figure 1:
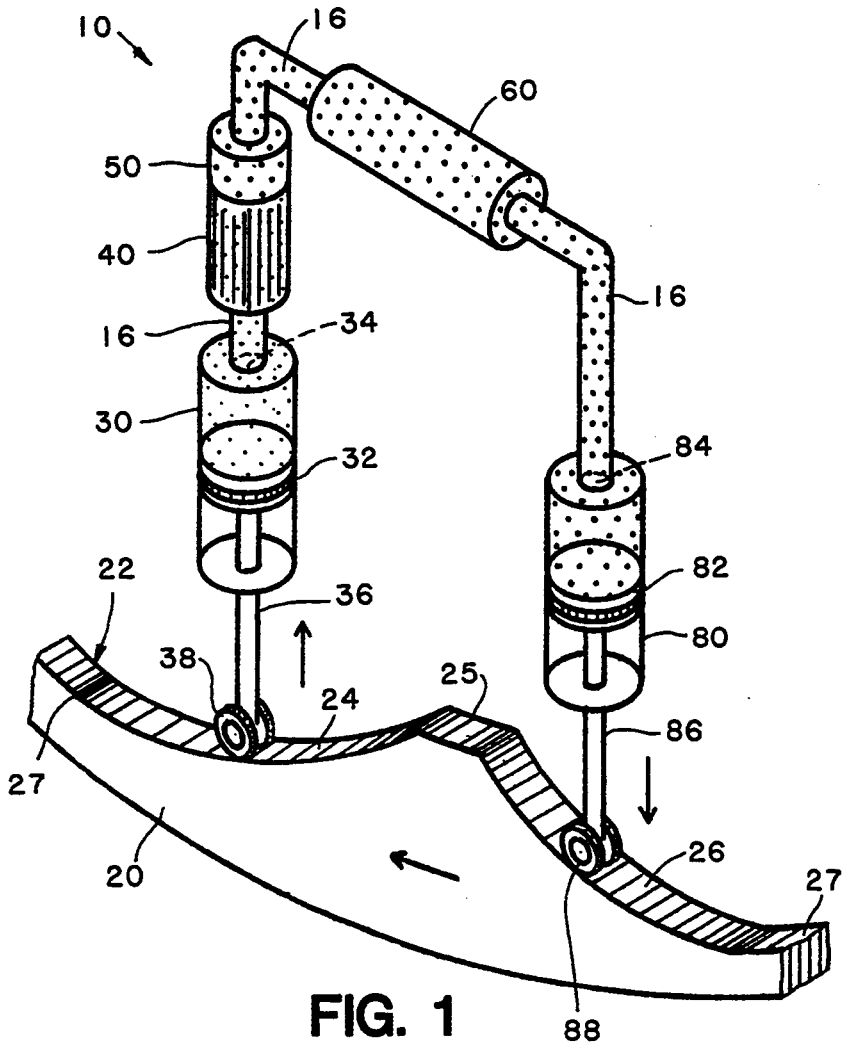
FIG. 1 is a schematic simplified view of a portion of a Stirling engine according to the invention.
Figures 2A, 2B, 2C, 2D, 2E:
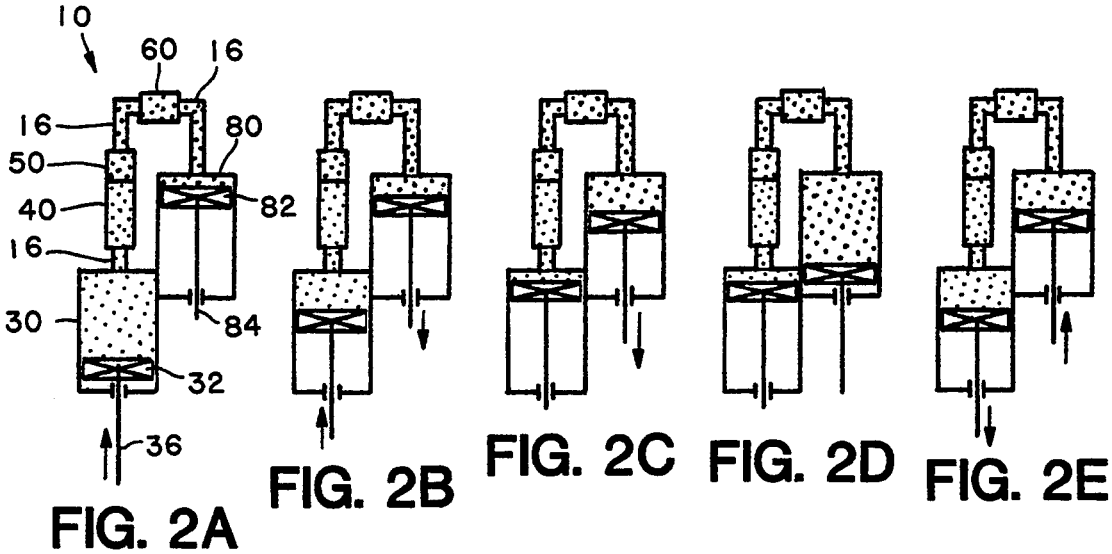
FIGS. 2A, 2B, 2C, 2D and 2E are schematic views of successive steps of the pistons shown in FIG. 1.

The following is a non restrictive list of the elements found in the drawings and described hereinafter:

10 engine
12 engine block
14 main axis
16 pipes
20 annular cam
21 external tooth
22 inner cam path
23 inner guide
24 upstroke portion
25 top dead center
26 downstroke portion
27 bottom dead center
28 guide plate
30 first cylinder
32 first piston
33 dynamic seal
34 opening
36 rod
38 roller
40 cooling means
42 heat exchanger
44 baffles
50 regenerator
60 heating means
62 housing
64 heat exchanger
66 burner
68 radial fan
69 duct
70 insulation chamber
72 air entry
74 exhaust pipe
76 hot section of heat exchanger
80 second cylinder
82 second piston
83 dynamic seal
84 opening
86 rod
88 roller
90 side shaft
92 gear
100 inner circle
102 outer circle
110 rod guide
112 copper sleeve
120 guide plate
122 radial roller
124 lateral roller
126 radial needle bearing
128 lateral needle bearing
130 built-in coolant circuit
140 spherical end
200 rod guide
202 chrome hole
204 sealing assembly
206 silicone ring
208 copper gasket
210 copper sleeve
212 hole
300 cylinders
310 pistons
320 rods
330 rollers

DESCRIPTION OF A PREFERRED EMBODIMENT

As aforesaid, a Stirling engine is a machine which operates on a closed regenerative thermodynamic cycle with periodic compression and expansion of a working gas at different temperature levels. It has pistons moving in cylinders but the movement of the pistons is not caused by a pressure variation due to the combustion of a gas as in the internal combustion engine. Instead, the Stirling engine uses a working gas circulating in closed circuit between one or more pairs of pistons. The flow of the working gas is controlled by volume changes in such a way as to produce a net conversion of heat to work.

Referring to FIG. 1, showing a schematic and very simplified view of the Stirling engine 10 according to the present invention, there is provided a first cylinder 30 in which is located a first piston 32. The piston 32 is forced into successive reciprocal movements by a rotating annular cam 20 on which it is operatively connected thereto by appropriate means, which may comprise a radial rod 36, the working gas is moved in or out of the cylinder 30 through an opening 34.

The opening 34 is connected to a first end of a cooling means 40 for cooling the working gas. The cooling means 40 is cooled by a cooling fluid, preferably consisting of water. Alternatively, air or another gas can be used.

A second end of the cooling means 40 is connected to a regenerator 50. The regenerator 50 consists of a thermal "sponge" placed in the flow of the working gas for storing heat when the working gas is hot and restoring heat when the working gas is cold. More particularly, it is used for storing heat from the working gas when flowing towards the cooling means 40, and restoring stored heat to the working gas when flowing away from the cooling means 40.

The regenerator 50 is connected to a first end of a heating means 60. The heating means 60 provides heat to the working fluid, preferably by means of continuous combustion of a liquid fuel. Of course, gaseous or solid fuels may be used.

The connections between the elements preferably comprise pipes 16.

The second end of heating means 60 is connected to an opening 84 of a second cylinder 80 in which is located a first piston 82. The piston 82 moves longitudinally in the cylinder 80. It is forced into successive reciprocal movements by the rotating annular cam 20 on which it is operatively connected thereto by appropriate means, which may comprise a radial rod 86, and by the working gas which pushes on the top of piston 82 during the power phase.

The working gas is located in the cylinders 30 and 80, in front of their respective piston, and in the circuit comprising the cooling means 40, the regenerator 50, the heating means 60 and the pipes 16. The working gas is generally helium because of the low viscosity and the good thermal properties thereof. Another commonly used working gas is hydrogen having even lower viscosity. However, helium is usually preferred since its manipulation is less dangerous. Of course, other gases may also be suitable. The initial pressure of the working gas is typically between 7 and 10 bars.

FIGS. 2A, 2B, 2C, 2D and 2E show the engine cycle of the engine 10 at different stages of operation. The cycle includes a power phase and a return phase separated by dead centers. During the power phase (2A, 2B), the working gas is compressed in the cylinder 30. The working gas heats up, but since it is in the cool region of the engine 10, it is constantly cooled. The flow of the compressed and cooled working gas through the regenerator 50 allows it to absorb heat stored during a previous cycle. The working gas then flows through the heating means 60 where it is heated at a relatively constant temperature.

The expansion of the hot working gas in the cylinder 80 pushes the piston 82 (2B, 2C, 2D). Then, the piston 82 drives out the still hot expanded working gas towards the regenerator 50 where some of the heat is absorbed.

The cooled working gas goes enters the cylinder 30 as the piston 32 moves backwards so that the operation is done with a relatively constant volume (2D, 2E, 2A). A new cycle can begin thereafter.

The work produced by the engine 10 is the difference between the work generated by the expansion of the working gas (2B, 2C, 2D) and the work required for the compression (2A and 2B).

Figure 3:
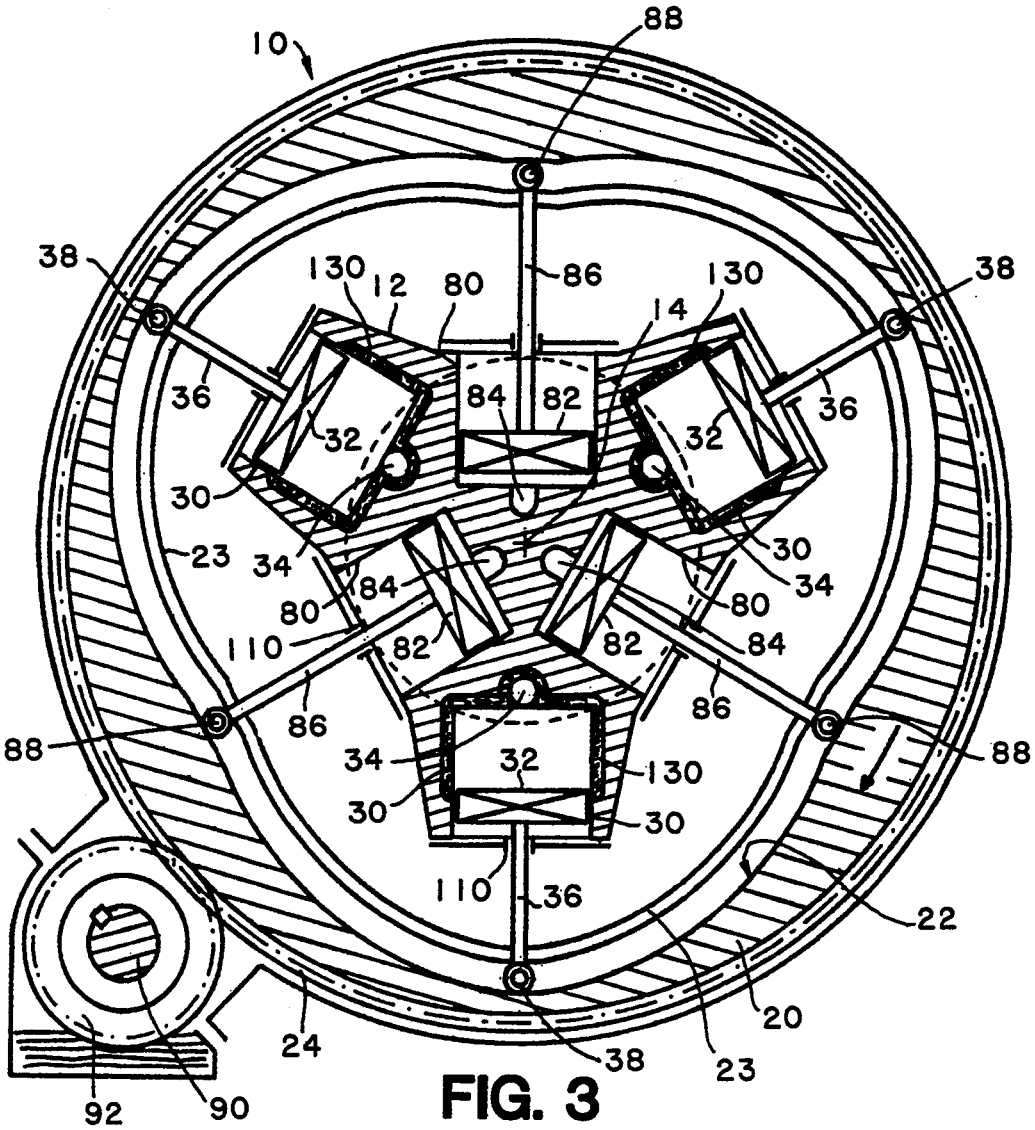
FIG. 3 is a cross-sectional view of a Stirling engine according to the invention, with three pairs of first and second cylinders.

Referring to FIG. 3, there is shown an example of an engine block 12 in which are located the cylinders 30 and 80. Preferably, the engine block 12 is made of aluminium alloy. The cylinders 30 and 80 are radially and symmetrically disposed at 120° in the engine block 12 around a main axis 14, which substantially corresponds to the geometrical center of the engine block 12. In FIG. 3, three pairs of cylinders are used, but one, two or more than three may also be suitable depending on the design requirements. The cylinders 30 and the cylinders 80 are disposed alternatively. The cylinders 30 are located in a "cooler region" while the cylinders 80 are located in a "hotter region".

Each cylinder 30 or 80 has an opening, respectively numbered 34 or 84, adjacent the main axis 14. As aforesaid, the openings 34 are connected to cooling means 40 and the openings 84 are connected to heating means 60. The cylinders 30 and 80 may be made of spheroidal graphite ferrochrome.

Each cylinder 30 has a piston 32 located therein for transferring the working gas to cylinder 80 during the power phase. The piston 32 comprises a dynamic seal 33 (FIG. 9) for preventing some working gas from escaping through the interstice between the cylinder 30 and the piston 32.

Each cylinder 80 has a piston 82 located therein for transmitting power to the annular cam 20 during the power phase. The piston 82 also comprises a dynamic seal (not shown) for preventing some working gas from escaping through the interstice between the cylinder 80 and the piston 82.

Both pistons 32 and 82 are contributing to the transfer of the working gas into the cylinder 30 during the return phase.

The annular cam 20 is substantially concentric with the main axis 14 and rotatable around it. The annular cam 20 has an inner cam path 22 corresponding to at least one engine cycle, which, as aforesaid, includes the power phase, the return phase and dead centers. The inner radius of the annular cam 20 is a function of the angular position. The cam path 22 has a smooth surface with no sharp angles for lowering the vibrations and for preventing rapid deterioration of the elements. The sense of rotation is very important when using a double annular cam 20. Additionally, it may be important to avoid an inverse rotation of the annular cam 20 if the mechanism driven by the engine 10 cannot work in both directions.

The annular cam 20 shown in FIG. 3 has three engine cycles.

Means for operatively connecting the pistons 32 and 82 to the annular cam 20 are provided. Those means allow the pistons 32 and 82 to be at radial positions which is a function of an angular position of the annular cam 20. It comprises rods 36 and 86 rigidly attached to a bottom side of each piston 32 and 82, respectively, and projecting out of the corresponding cylinder 30 or 80. Respective rollers 38 and 88, preferably identical, roll on the cam path 22 for following it in order to impose a reciprocal movement to the corresponding piston 32 or 82. Each roller 38 or 88 is set between the cam path 22 and an inner guide 23 substantially parallel to the cam path 22. The distance between the cam path 22 and the inner guide 23 is about the diameter of the rollers 38 and 88 plus a small tolerance.

Rod guides 110 maintain the rods 36 or 87 in a radial position, thus allowing only successive radial reciprocal movements thereof and of their corresponding piston 32 or 82 upon rotation of the annular cam 20.

A side shaft 90 is provided with a gear 92 in mesh with tooth 24 located on the periphery of the annular cam 20. The side shaft 90 allows the output power to be used for driving a given mechanism. It is also preferably used for connecting a starter (not shown). The side shaft 90 may be part of a gearbox in which lubrication is made by splashing.

There is also the possibility of having three planetary gears (not shown) symmetrically disposed at 120° around a sun gear (not shown) concentric with the main axis 14. This arrangement may provide a very stable construction as well as a way of providing demultiplication of the rotation speed.

Figure 4A:
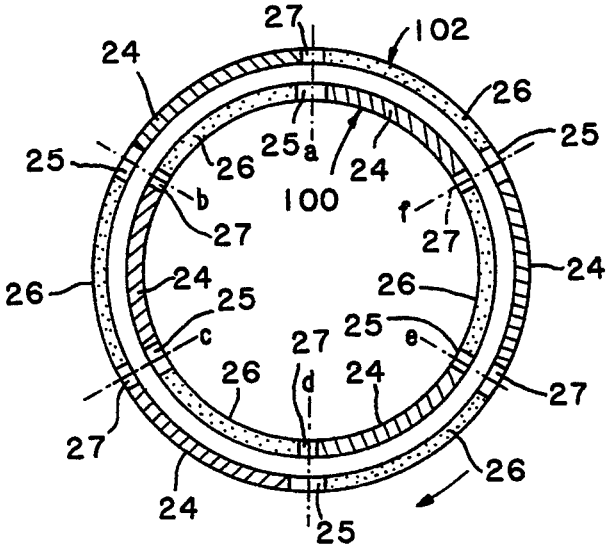
FIG. 4A is a diagram showing, as an example, successive steps encountered by the pistons of FIG. 3 with the use of a single annular cam.

Referring to FIG. 4A, illustrating an example of the successive steps encountered by the pistons 32 and 82 of FIG. 3 using a single annular cam 20, the inner circle 100 illustrates the movements of the rollers 88 and the outer circle 102 shows the movements of the rollers 38, thereby showing the movements of the pistons 32 and 82 since they are connected respectively to the rollers 38 and 88 by the rods 36 and 86.

Each segment of the circles 100 and 102 and of the cam path 22 corresponds to an engine cycle which comprises an upstroke portion 24 where the inner radius decreases, a top dead center 25 where the inner radius is minimum, a downstroke portion 26 where the inner radius increases, and a bottom dead center 27 where the inner radius is maximum.

The circles 100 and 102 of FIG. 4A are divided in three cycles of 120°, namely A–C, C–E and E–A. While one roller 38 is in an upstroke portion 24, the corresponding roller 88 of the same circuit is in a downstroke portion 26, and vice-versa. Alternatively, when a roller 38 is at a top dead center 25, the corresponding roller 88 is substantially at a bottom dead center 27. In the example of FIG. 4A, each upstroke portion 24 and downstroke portion 26 has an angular value of 52°. Each top dead center 25 has an angular value of 10° and each bottom dead center 27 has an angular value of 6°.

The annular cam 20 may comprise one or two annular parts. In the two part embodiment, the parts are adjacent to each other in the radial plane, as shown in FIG. 4C. One part is provided for moving the pistons 32 and the other is provided for moving the pistons 82. The purpose of using two parts is to allow slightly non synchronized movements of the first and second pistons by favouring a greater compression time.

Figure 4B:
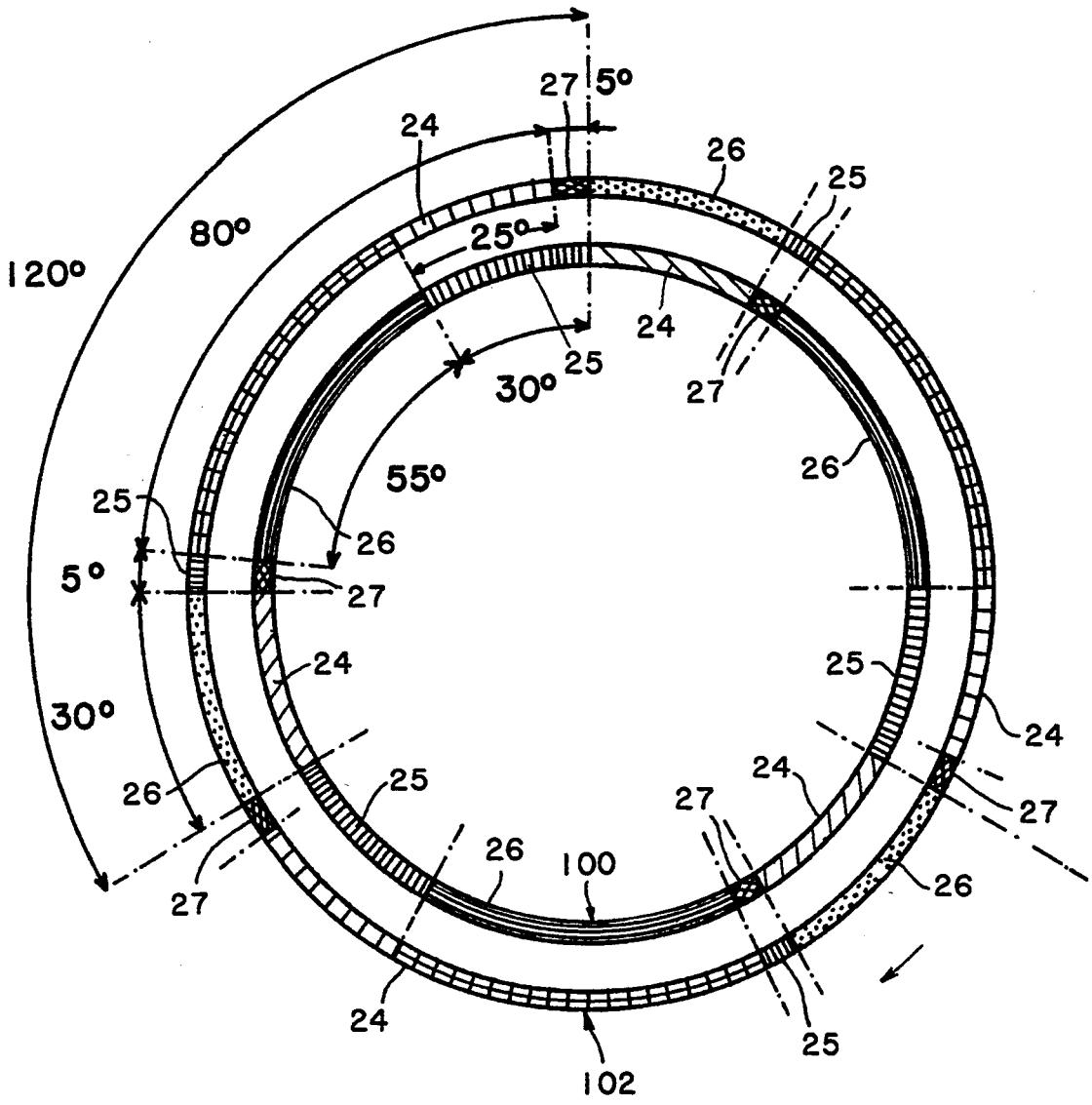
FIG. 4B is a diagram showing, as an example, successive steps encountered by the pistons of FIG. 3 using a double annular cam.
Figure 4C:
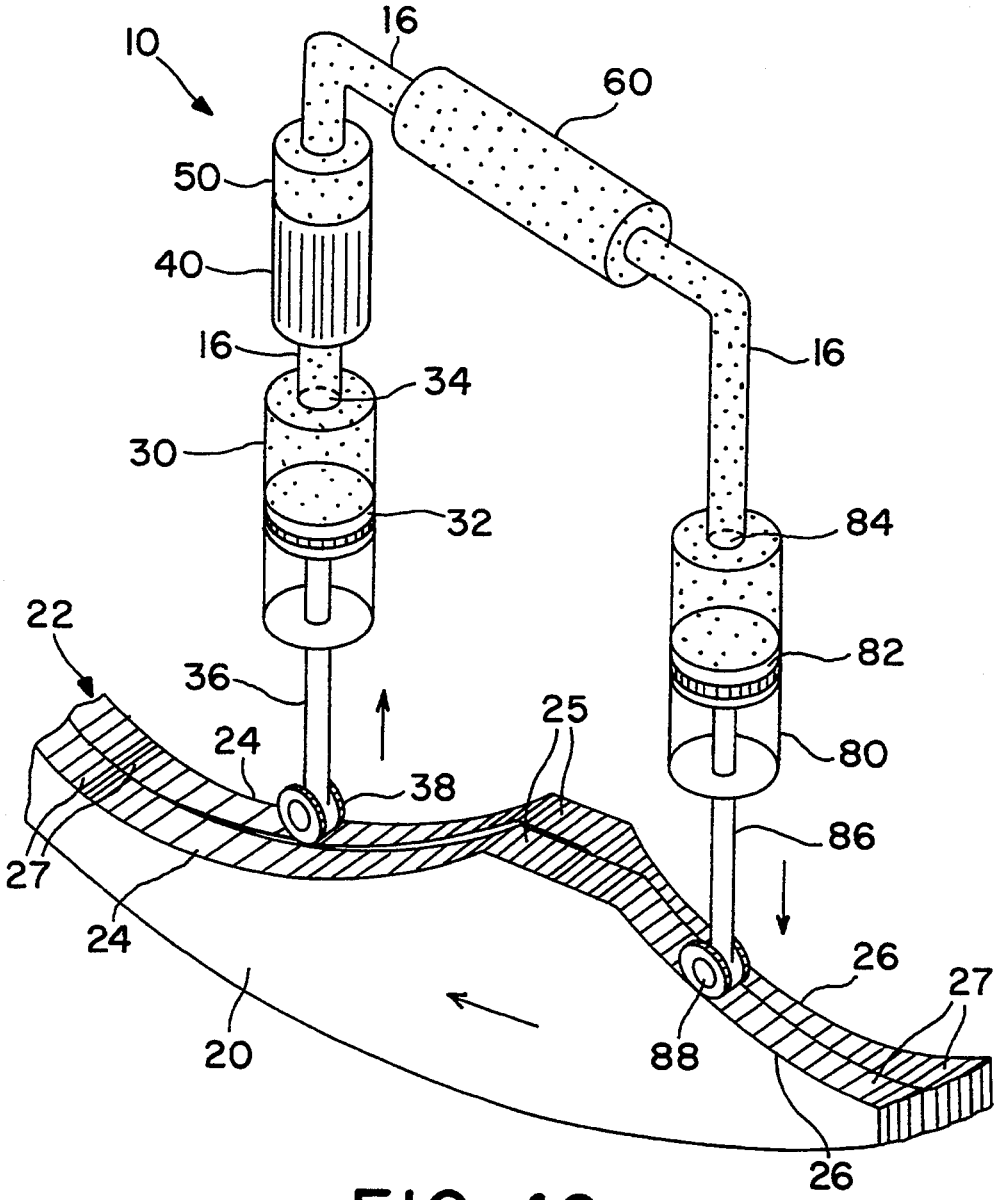
FIG. 4C is a schematic simplified view of a portion of another Stirling engine according to the present invention.

Referring to FIG. 4B, showing an example of the successive steps encountered by the pistons of FIG. 3 using a double annular cam 20, both parts of the annular cam 20 may be slightly non synchronized.

In this example, the inner circle 100 illustrates the movements of the rollers 88 and the outer circle 102 illustrates the movements of the rollers 38. The circles 100 and 102 have three identical cycles of 120°, each divided in an upstroke portion, a top dead center, a downstroke portion and a bottom dead center.

In the inner circle 100, each upstroke portion 24 has an angular value of 30°, each top dead center 25 has an angular value of 30°, each downstroke portion 26 has an angular value of 55° and each bottom dead center 27 has an angular value of 5°.

In the outer circle 102, each upstroke portion 24 has an angular value of 80°, each top dead center 25 has an angular value of 5°, each downstroke portion 26 has an angular value of 30° and each bottom dead center 27 has an angular value of 5°.

As it can be seen in the example, the upstroke portion 24 of the rollers 38 is about 25° longer than the corresponding downstroke portion 26 of the corresponding roller 88. Therefore, the top dead center 25 of the roller 88 is 25° longer than the corresponding bottom dead center 27 of the corresponding roller 38.

Figure 5:
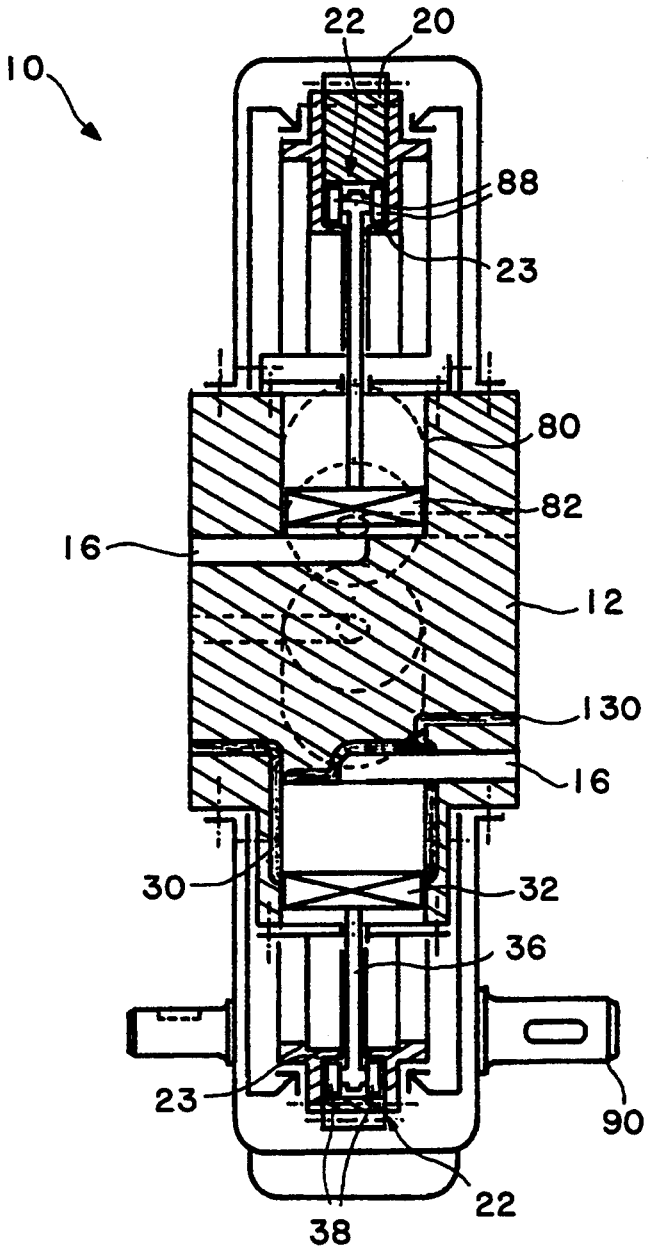
FIG. 5 is a cross-sectional, partial schematic view of the Stirling engine according to line V—V of FIG. 3.
Figure 9:
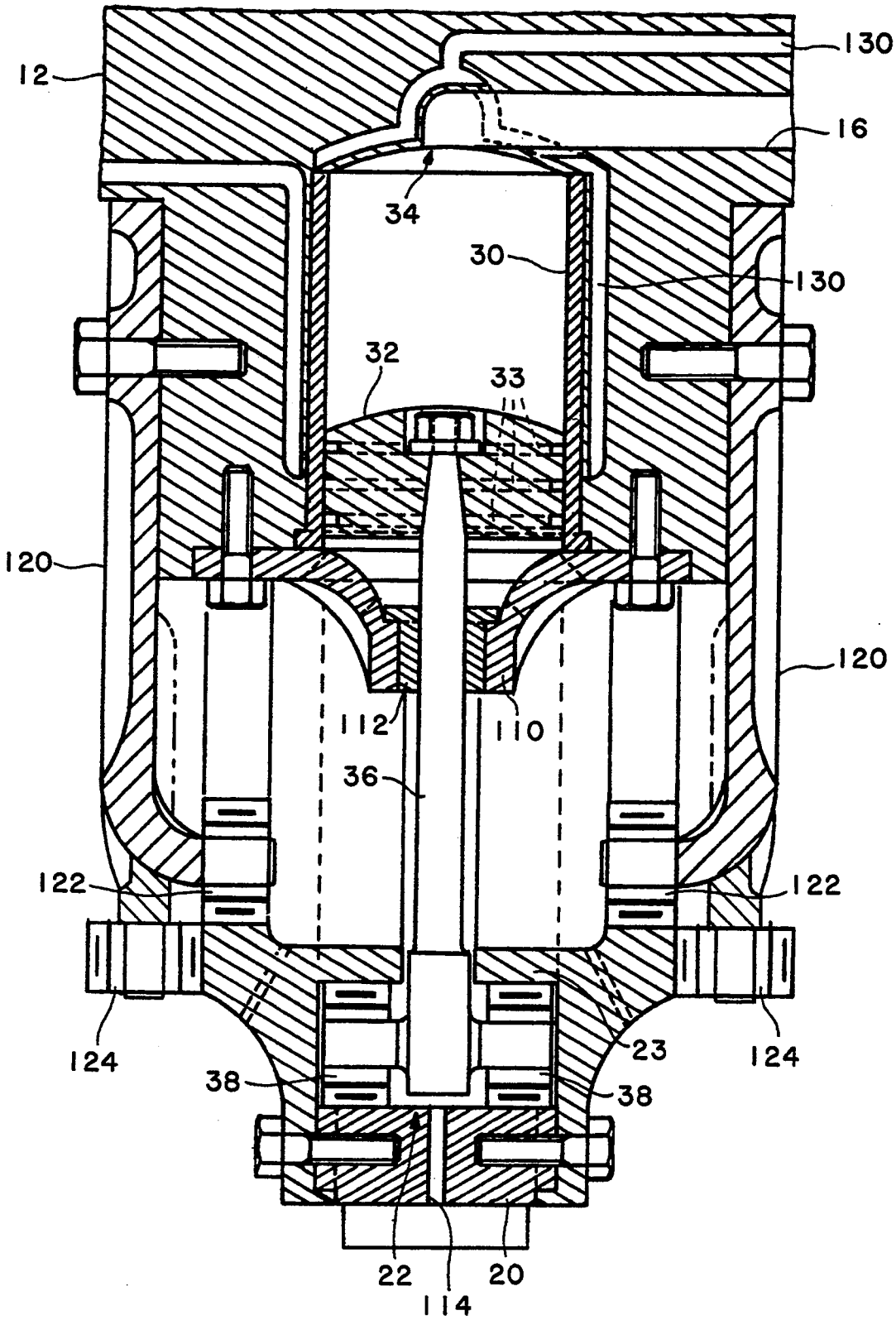
FIG. 9 is an enlarged cross-sectional view of a first cylinder shown in FIG. 5.
Figure 14:
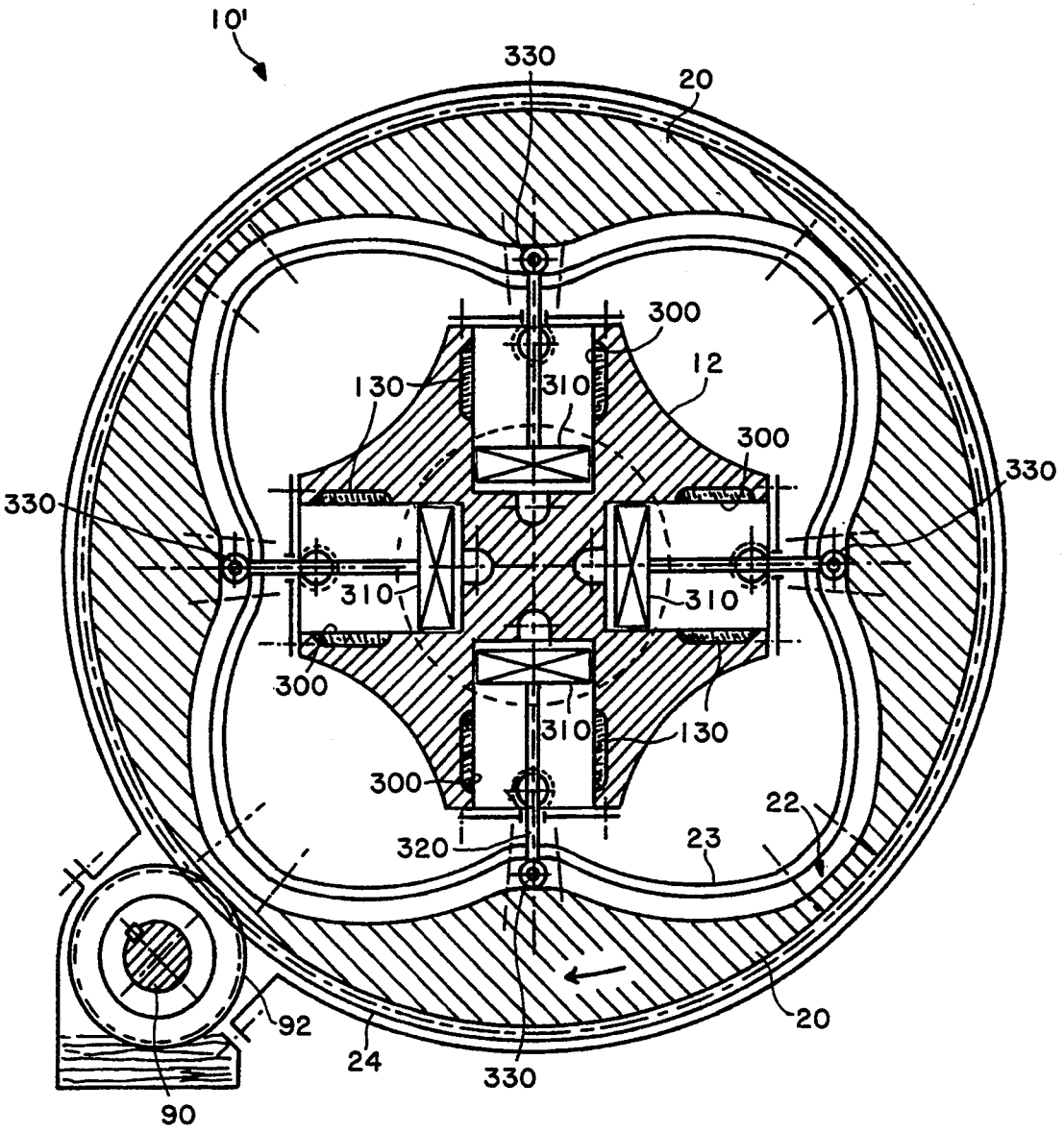
FIG. 14 is a cross-sectional view of the Stirling engine shown in FIG. 13.

Referring to FIG. 5, there may be provided means for cooling the cylinders 30. Since the compression of the working gas generates heat, those means may be suitable for helping controlling the temperature. It may also evacuate heat for the adjacent cylinders 80 coming through the engine block 12 and assist the cooling means 40. The means may comprise built-in coolant circuit 130 provided around the cylinders 30 and linked to a pump (not shown) and a heat exchanger (not shown). The built-in coolant circuits 130 are also shown in FIGS. 3, 9 and 14.

Figure 6:
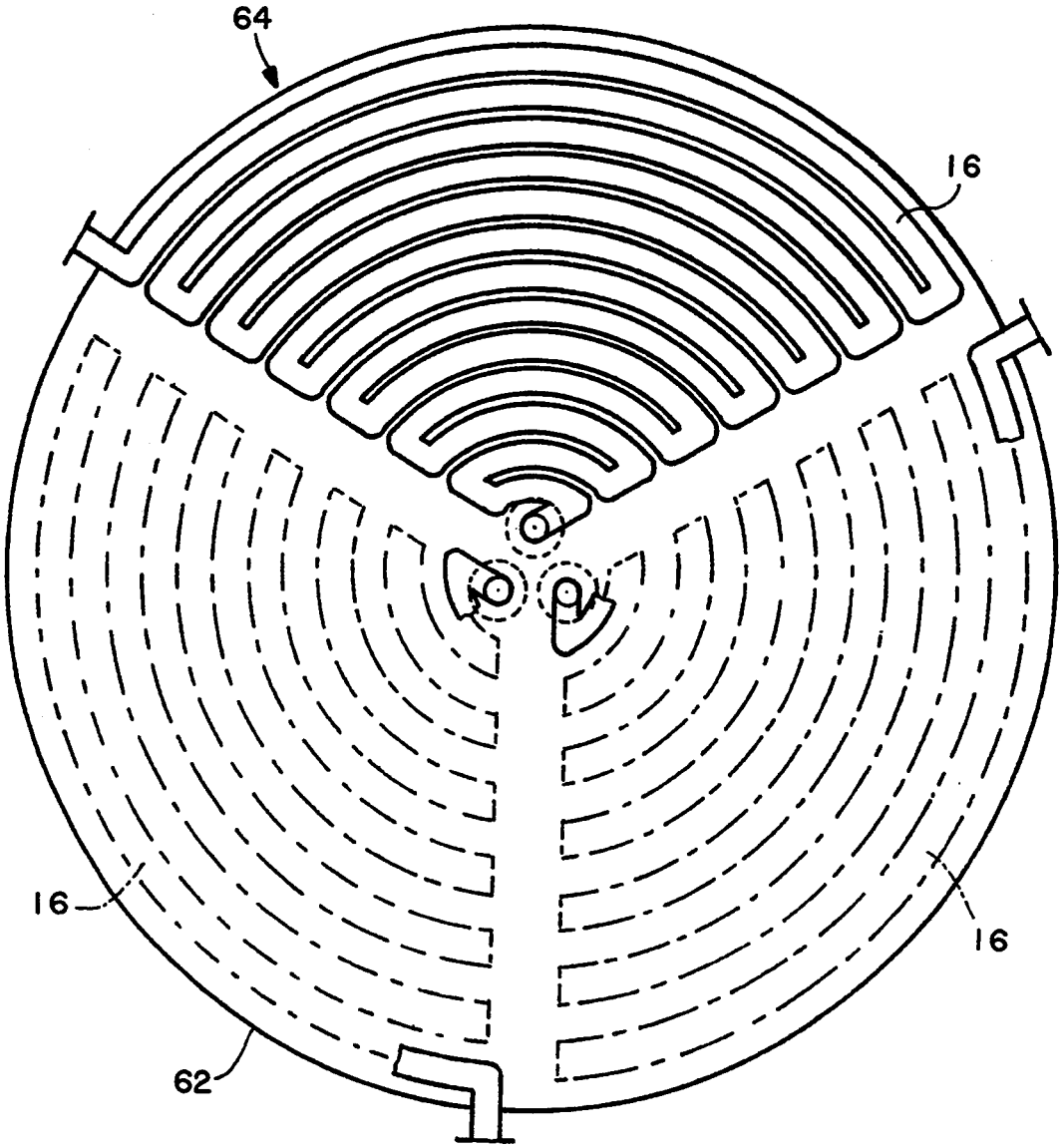
FIG. 6 is a partial front elevational view of a heat exchanger of a heating means according to the present invention.

Referring to FIG. 6, showing a partial front elevational view of the heat exchanger 64 of the heating means 60, the working gas of each circuit is circulating in heat-resistant steel or ceramic pipes 16 arranged as a triangular coil. Each circuit of working gas is independent from the others. The pipes 16 of each circuit have substantially the same heat exchange area. The heat exchanger 64 receives the heat from the heat source and transmits it to the working gas. The heat exchanger 64 preferably is in the form of a spiral circling around the main axis 14 for improving the flow of the working gas.

Figure 7:
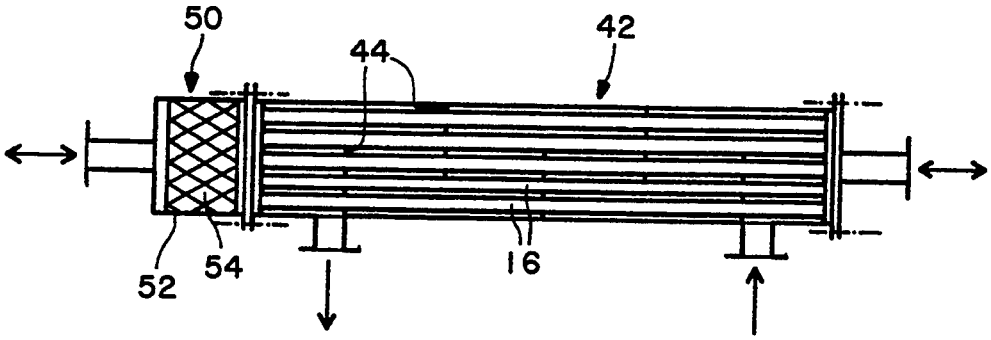
FIG. 7 is a side elevational view of regenerator and heat exchanger of a cooling means according to the present invention.

Referring to FIG. 7, showing the regenerator 50 and the heat exchanger 42 of the cooling means 40, the working gas of each circuit is circulating in a corresponding heat exchanger 42 in which a coolant, preferably water, is circulated on the other side. Of course, all the heat exchangers 42 may be regrouped in only one, but each circuit has to be independent from the others in order to avoid mixing the working gas of each circuit. The kind of heat exchangers 42 that is used depends on the design requirements. In the example of FIG. 7, the pipes 16 within the heat exchanger 42 may be made of copper and the water side comprises baffles 44. Preferably, the water enters the heat exchanger 42 at the end near the cylinders 30.

The coolant for the heat exchanger 42 may also be air. That heated air may also be further used in the heating means 60 as comburent, if appropriate.

The regenerator 50 preferably comprises a heat-resistant or ceramic casing 52 in which is located some finely divided stainless steel 54. As aforesaid, the regenerator 50 is like a thermal sponge which is storing or restoring heat.

Figure 8:
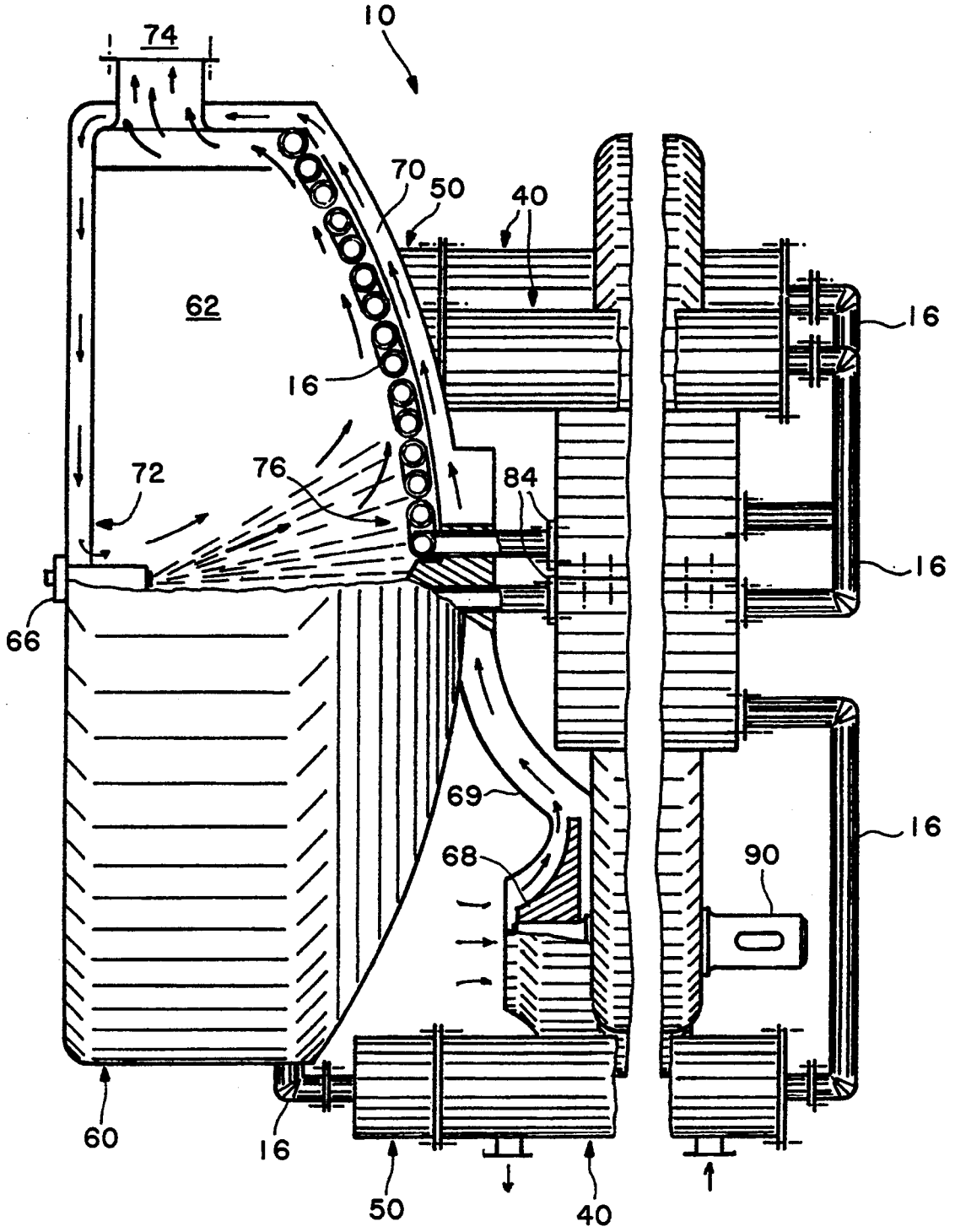
FIG. 8 is a partial side elevational view partially in cross-section of a Stirling engine according to the present invention.

Referring to FIG. 8, showing an example of the Stirling engine with a partial cross-sectional view of the heating means 60 and a fan 68, preferably a radial fan, the heating means 60 comprise a housing 62 and a fuel burner 66. The combustion of the fuel generates a flame heating the pipes 16. A spark-plug (not shown) ignites the fuel.

The design of the heating means 60 is largely dependent on the kind of fuel used. As aforesaid, the fuels may be liquid, gaseous or solid. Solar energy and geothermal heat may even be suitable. The engine 10 thus allows the use of commonly used fuels, such as gasoline or natural gas, but also fuels like heavy oils, kerosene, powdered coal, industrial waste or biogases. Even waste heat from another engine or process may be suitable.

The continuous external combustion is easier to control than a successive internal combustion. Since the external combustion is more adequate and more complete, the quantity of noxious gases, such as carbon and nitrogen monoxide, or hydrocarbons, is lowered. The exhaust system is thus very simple since it does not require a catalyst. Moreover, the external combustion allows the use of the exhaust heat for preheating the comburent air. Therefore, the temperature of such exhaust gases is relatively low, more particularly in the order of 100° to 150° C.

In order to get a combustion as perfect as possible, a computer (not shown) may be used for controlling the heating means 60 by switching the burner 66 on and off at a suitable time, controlling the air flow and the fuel flow, limiting the rising of the temperature of the engine 10, etc. The atmospheric pressure, the quantity of carbon dioxide in the exhaust gases and the rotation speed of the annular arm 20 are also suitable information.

The maximum temperatures of the engine 10 are dependent on the materials that are used. Since the efficiency of the engine 10 is a function of the highest and the lowest temperature therein, as shown by the Carnot cycle, special alloys or ceramics may be used for allowing continuously very high temperatures and high temperature gradients.

The fan 68 is directly driven by the engine 10 itself, although it may also be driven by an external power source. It is not however an essential element since the flame may generate a suitable natural air in-draft. Nevertheless, it is advantageous to have an electric fan (not shown) for the start-up period. This electric fan may be servo-controlled for reducing the air flow as the fan 68 gains speed.

The air is urged inside the housing 62 after being pushed by the fan 68. A duct 69 links the fan 68 to the housing 62. Preferably, the housing 62 has an insulation chamber 70 for lowering the temperature adjacent the outer surface of the housing 62 while preheating the air in order to get the temperature inside the housing 62 as high as possible. The air then gets into the housing 62 by an air entry 72 and the burned gases exit through the exhaust pipe 74. The hottest section 76 is near the center of heating means 60 so the section of the pipes 16 in the hottest section 76 is connected to the opening 84, since this arrangement is more suitable for obtaining the highest temperature of the working gas when entering the cylinders 80.

Figure 10:
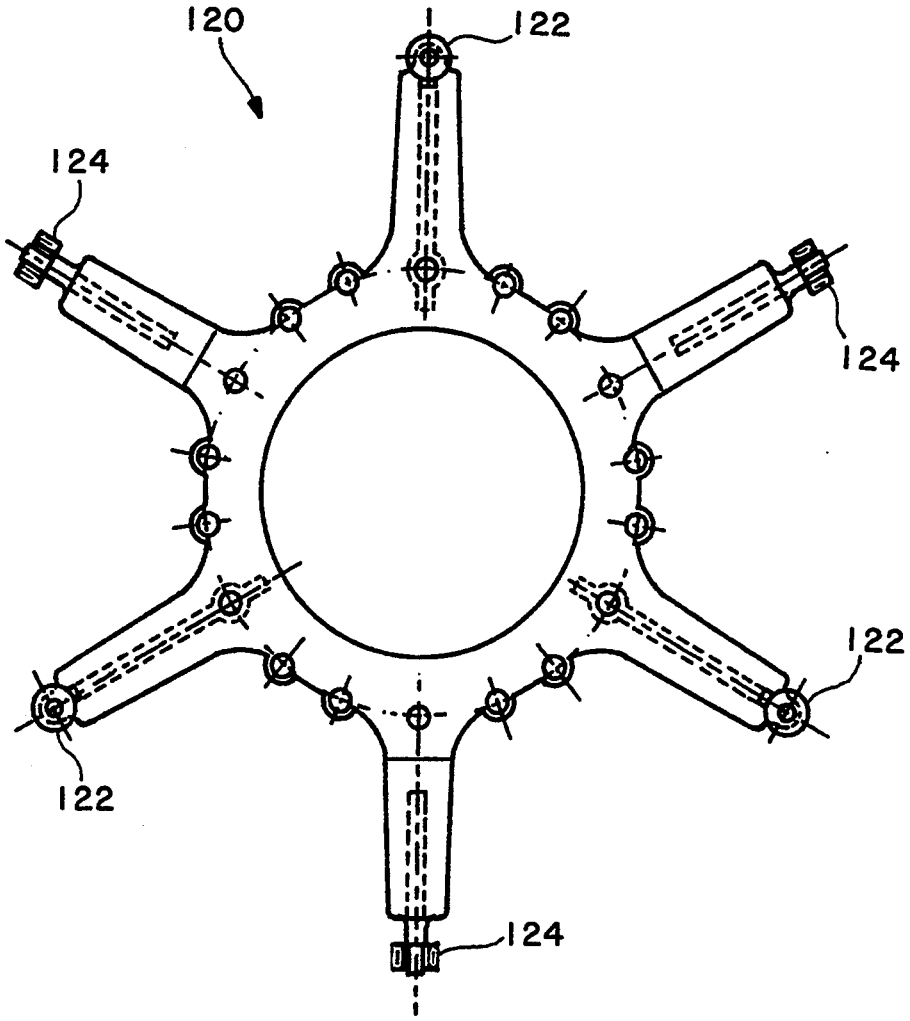
FIG. 10 is a front elevational view of an annular cam guide according to the present invention.

Referring to FIGS. 9 and 10, means for guiding the annular cam 20 around the engine block 12 are provided so that the annular cam 20 is maintained. The means comprise two guide plates 120 having radial rollers 122 and lateral rollers 124, respectively maintaining the annular cam 20 radially and axially. Each guide plate 120 is rigidly attached to the engine block 12.

Figure 11:
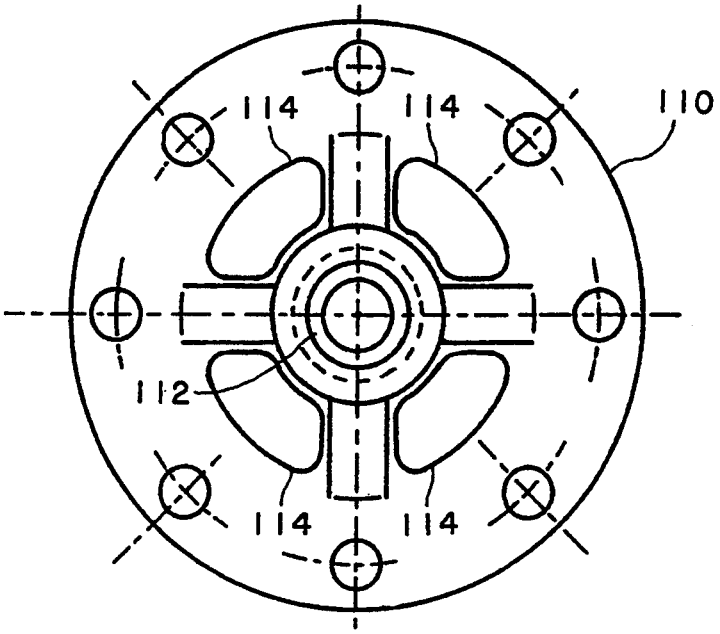
FIG. 11 is a front elevational view of a rod guide according to the present invention.

Referring to FIGS. 9 and 11, each rod guide 110 preferably comprises a copper sleeve 120 through which the corresponding rod 36 or 86 slides. The rod guides 110 are rigidly attached under the corresponding cylinders 30 or 80, and comprise openings 114 for preventing overpressure under the corresponding piston 32 or 82.

In order to reduce the working gas leaks around the pistons 32 and 82 in their respective cylinders 30 and 80, the interior of the engine 10 may be pressurized, preferably at a pressure of about the initial pressure of the working gas. A safety valve (not shown) prevents an overpressure.

Figure 12:
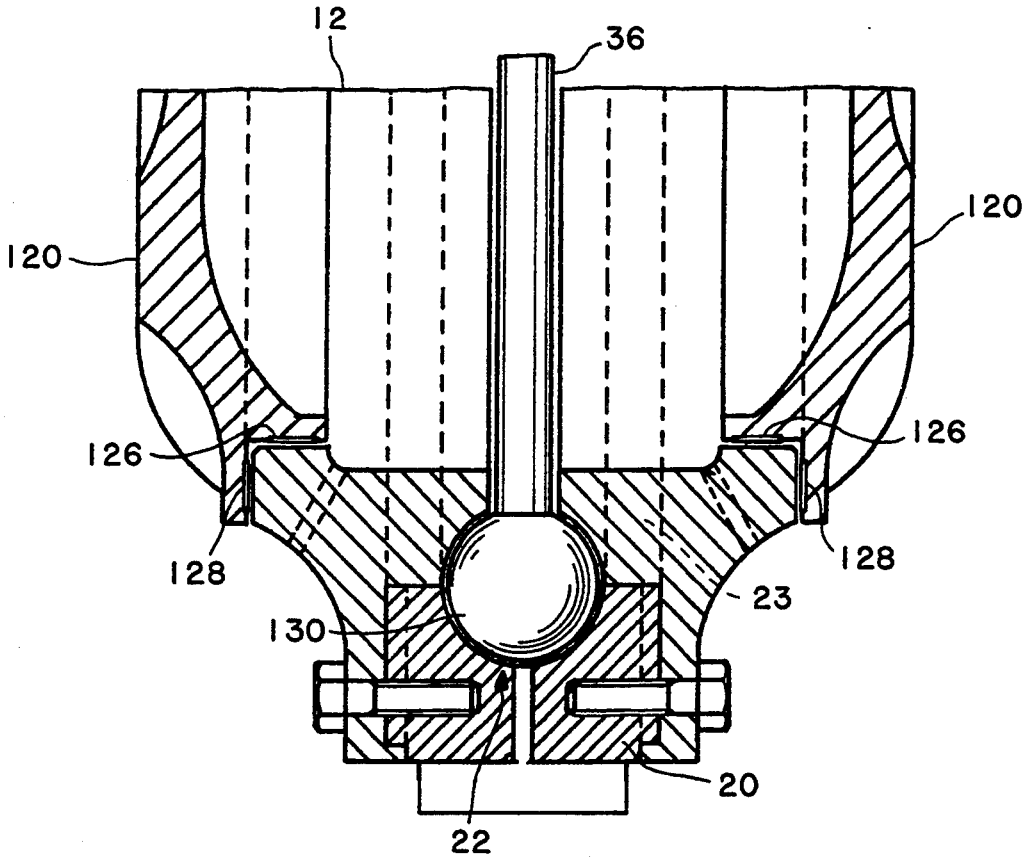
FIG. 12 is an alternative embodiment of the connection between the rod and the annular cam, and of the annular cam guide shown in FIG. 9.

Referring to FIG. 12, showing an alternative embodiment to the connection between the rods 36 and 86 with the annular cam 20 in small motors, each roller 38 or 86 may be replaced by a spherical end 140 made of a low friction material. Additionally, the rollers 122 and 124 of the guide plate 126 may be replaced respectively by needle bearings 126 and 128, which are made of a low friction material.

Figure 13:
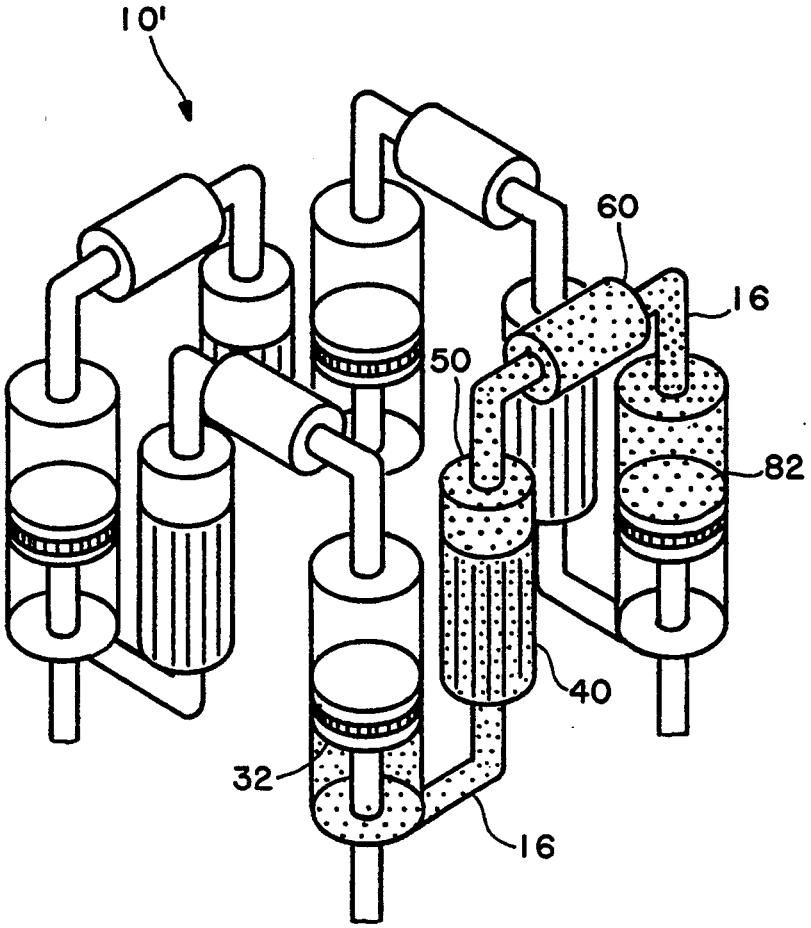
FIG. 13 is a schematic simplified view of another Stirling engine according to the present invention.

Referring to FIG. 13, the engine may be used as a double effect Stirling engine 10'. There is a minimum of two cylinders in that case.

In the double effect engine 10', the bottom of one piston becomes the "first piston 32" whilst the top of the other piston becomes "the second cylinder 82". There is thus a different circuit for every cylinder. All parts of the engine must be thermodynamically balanced for obtaining a good efficiency. Except for the connection of the circuits and a few components, the way the engine 10' is working is not substantially different from the single effect engine 10.

All the cylinders, the pistons, the rods and the rollers are identical. They are hereby renumbered as the cylinders 300, the pistons 310, the rods 320 and the rollers 330.

Referring to FIG. 14, showing a four cylinder double effect engine 10', the construction in very similar to the single effect engine, except that the connections between the cylinders are different and that the rod guides 110 used in the engine 10 have to be air tight.

Figure 16:
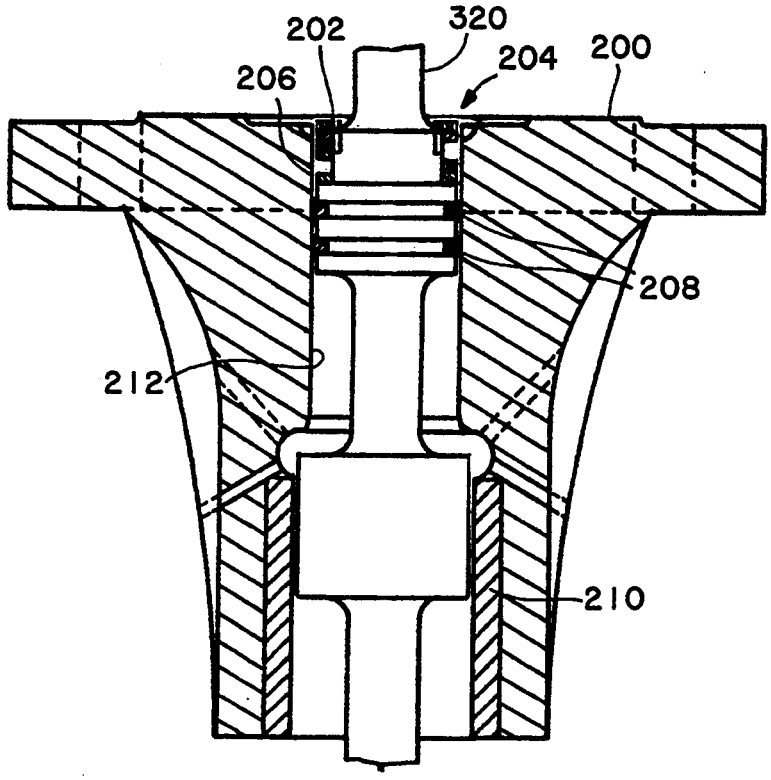
FIG. 16 is a cross-sectional view of the air-tight rod guide according to line XVI—XVI of FIG. 15.
Figure 15:
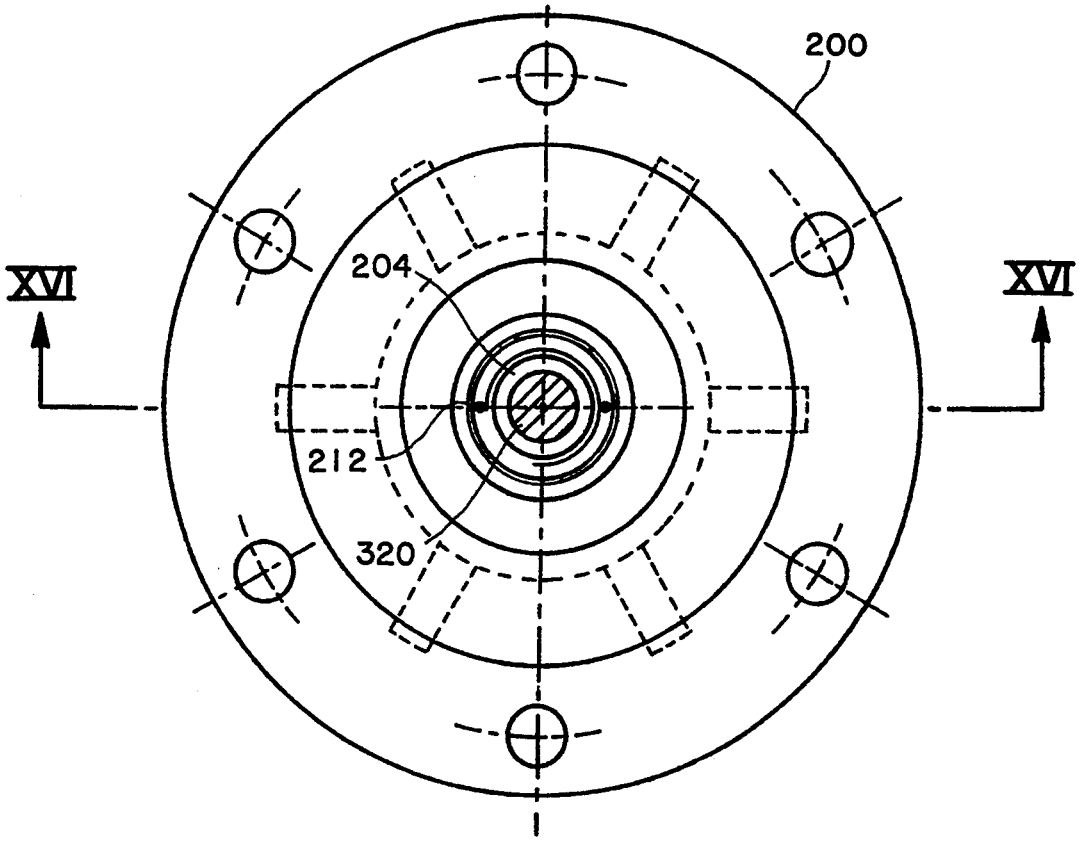
FIG. 15 is an upper elevational view of an air-tight rod guide according to the present invention.

Referring to FIGS. 15 and 16, there is shown the rod guide 200 suitable for every cylinder of the engine 10'. It comprises a chrome hole 202 in which slides the sealing assembly 204. The sealing assembly 204 preferably comprises silicone rings 206 and copper gaskets 208. The copper gaskets 208 comprise a stack of fine strips maintained against the hole 212 by a leaf spring. A portion of the rod 320 slides in a copper sleeve 210.

The built-in coolant circuits 130 are located in the bottom of the cylinders 300 since the compression of the working gas occurs at that location.

The above-described engine 10 is suitable for working in all positions. It may further be provided with a an auxiliary blower for initiating the flow of air into the heating means 60 when starting the engine 10 or during idling.

The advantage of the engine 10 are the low wear due to the absence of abrasive and corrosive residue from the internal combustion, the low number of mobile parts, the low maintenance requirement and the very few tuned up required during the life of the engine 10.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

I claim:

1. A Stirling engine having an engine block defining a main axis, said engine comprising:

a first and a second radial cylinder symmetrically disposed in said engine block around said main axis, each of said cylinders having a gas opening adjacent said main axis;

a circuit connected between said openings of said cylinders and containing a working gas, said circuit being provided with:

cooling means, connected to said opening of said first cylinder, for cooling said working gas;

regenerator means, connected to said cooling means opposite said first cylinder, for storing heat from said working gas when flowing towards said cooling means and restoring stored heat to said working gas when flowing away from said cooling means; and heating means for heating said working gas, said heating means having a first end connected to said regenerator means opposite said cooling means and a second end connected to said opening of said second cylinder;

an annular cam substantially concentric with said main axis and rotatable around said main axis, said annular cam having a smooth inner cam path corresponding to at least one engine cycle including a power phase and a return phase separated by dead centers;

means for guiding said annular cam around said engine block;

a first piston located in said first cylinder for compressing and transferring said working gas to said second cylinder during said power phase;

a second piston located in said second cylinder for transmitting power to said annular cam during said power phase; and means for operatively connecting said pistons to said annular cam, whereby, in use, said annular cam is rotated with respect to said engine block and receives power from said second piston.

2. A Stirling engine according to claim 1, wherein said annular cam comprises a first and a second annular part adjacent to each other in a radial plane, said means for operatively connecting said pistons to said annular cam connecting said first piston to said first part and said second piston to said second part.

3. A Stirling engine according to claim 1, wherein said means for operatively connecting said pistons to said annular cam comprise:

radial rods rigidly attached respectively to said first and second pistons, and outwardly projecting therefrom; and means connected at a free end of each rod for following said cam path, whereby said rod is moved into reciprocal radial movements upon rotation of said annular cam.

4. A Stirling engine according to claim 3, wherein said means for following said cam path comprise a roller operatively connected to said annular cam between said cam path and an inner guide substantially parallel to said cam path.

5. A Stirling engine according to claim 1, further comprising means for cooling said first cylinder.

6. A Stirling engine according to claim 1, wherein said heating means comprise a fuel burner.

7. A Stirling engine according to claim 4, wherein said heating means comprise a fan driven by said engine and providing air to said heating means for allowing fuel to burn.

8. A Stirling engine having an engine block defining a main axis, said engine comprising:

three first radial cylinders symmetrically disposed in said engine block around said main axis, each of said first cylinders having a gas opening adjacent said main axis;

three second radial cylinders symmetrically disposed in said engine block around said main axis, each of said second cylinders having a gas opening adjacent said main axis;

three circuits containing a working gas, each connected between openings of a corresponding pair of said first and second cylinders, each circuit being provided with:

cooling means, connected to said opening of the corresponding first cylinder, for cooling said working gas;

regenerator means, connected to said cooling means opposite the corresponding first cylinder, for storing heat from said working gas when flowing towards said cooling means and restoring stored heat to said working gas when flowing away from said cooling means; and heating means for heating said working gas, said heating means having a first end connected to said regenerator means opposite said cooling means and a second end connected to said opening of the corresponding second cylinder;

an annular cam substantially concentric with said main axis and rotatable around said main axis, said annular cam having a smooth inner cam path corresponding to three engine cycles, each including a power phase and a return phase separated by dead centers;

means for guiding said annular cam around said engine block;

first pistons located respectively in said first cylinders for compressing and transferring said working gas from said first cylinders to said second cylinders during said power phase;

second pistons located respectively in said second cylinders for transmitting power to said annular cam during said power phase and for transferring said working gas from said second cylinders to said first cylinders during said return phase; and means for operatively connecting said pistons to said annular cam, whereby, in use, said annular cam is rotated with respect to said engine block and receives power from said second piston.

9. A Stirling engine having an engine block defining a main axis, said engine comprising:

at least two radial cylinders symmetrically disposed in said engine block around said main axis, each of said cylinders having a first gas opening opposite said main axis and a second gas opening adjacent said main axis;

at least two circuits for connecting respectively said at least two cylinders, each of said circuits being connected respectively between said first opening of one cylinder and said second opening of an adjacent cylinder, each of said circuits containing a working gas and being provided with:

cooling means, connected to said first opening of a corresponding cylinder, for cooling said working gas;

regenerator means, connected to said cooling means opposite said first opening of said corresponding cylinder, for storing heat from said working gas when flowing towards said cooling means and restoring stored heat to said working gas when flowing away from said cooling means; and heating means for heating said working gas, said heating means having a first end connected to said regenerator means opposite said cooling means and a second end connected to said second opening of another corresponding cylinder;

an annular cam substantially concentric with said main axis and rotatable around said main axis, said annular cam having an inner cam path corresponding to at least one engine cycle including a power phase and a return phase separated by dead centers;

means for guiding said annular cam around said engine block;

one piston located in each cylinder for simultaneously transferring said working gas to an adjacent cylinder and transmitting power to said annular cam; and means for operatively connecting said pistons to said annular cam, whereby, in use, said annular cam is rotated with respect to said engine block and receives power from said pistons.

* * * * *